US006181306B1

(12) United States Patent
Specty et al.

(10) Patent No.: US 6,181,306 B1
(45) Date of Patent: Jan. 30, 2001

(54) METHOD FOR ADJUSTING THE OVERALL LUMINOSITY OF A BISTABLE MATRIX SCREEN DISPLAYING HALF-TONES

(75) Inventors: Michel Specty, Saint Egreve; Philippe Zorzan, Grenoble, both of (FR)

(73) Assignee: Thomson Tubes Electroniques, Velizy (FR)

( * ) Notice: Under 35 U.S.C. 154(b), the term of this patent shall be extended for 0 days.

(21) Appl. No.: 08/927,668

(22) Filed: Sep. 10, 1997

Related U.S. Application Data

(63) Continuation of application No. 08/348,122, filed on Nov. 28, 1994, now abandoned.

(30) Foreign Application Priority Data

Dec. 3, 1993 (FR) ..... 93 14522

(51) Int. Cl.[7] ..... G09G 3/28
(52) U.S. Cl. ..... 345/63; 345/87
(58) Field of Search ..... 345/55, 63, 68, 345/87, 99, 100, 112; 315/169.4

(56) References Cited

U.S. PATENT DOCUMENTS 4,140,945 * 2/1979 Irogdon ..... 345/63
4,415,892 * 11/1983 Marentic ..... 345/63
4,499,460 * 2/1985 Pearson et al. ..... 345/68
5,030,888 7/1991 Salavin et al. .
5,066,890 11/1991 Salavin et al. .
5,075,597 12/1991 Salavin et al. .
5,237,315 * 8/1993 Gay et al. ..... 345/55 X
5,343,215 * 8/1994 Tanaka ..... 345/63
5,541,618 * 7/1996 Shinoda ..... 345/63

FOREIGN PATENT DOCUMENTS 0 457 638 A1 11/1991 (EP) .
0 549 275 A1 6/1993 (EP) .

OTHER PUBLICATIONS

English Abstract of Japanese Patent No. 4248588, Sep. 4, 1992.

* cited by examiner

*Primary Examiner*—Amare Mengistu
(74) *Attorney, Agent, or Firm*—Oblon, Spivak, McClelland, Maier & Neustadt, P.C.

(57) ABSTRACT

In a method for adjusting the overall luminosity of at least a part of a matrix screen, each row of the part is processed several times non-periodically to display half-tones. Each processing consists of a semi-selective operation followed by a selective operation. A delay is planned between the selective operation and the semi-selective operation, this delay being proportional to a weighting factor that is adjustable as a function of the desired overall luminosity and proportional to the time interval between the beginning of the treatment in progress and the beginning of the next treatment.

13 Claims, 7 Drawing Sheets

| TONE LEVEL | ORDER AT THE INSTANT 0' a' b' c' | PERIOD OF ILLUMINATION OR LUMINANCE |
|---|---|---|
| 0 0 0 0 | E E E E | (1-k)0 → $\frac{0}{15}$.NTb |
| 1 0 0 0 | A E E E | (1-k)a → $\frac{(1-K)}{15}$.NTb |
| 0 1 0 0 | E A E E | (1-k)(b-a) → $\frac{2(1-K)}{15}$.NTb |
| 1 1 0 0 | A A E E | (1-k)b → $\frac{3(1-K)}{15}$.NTb |
| 0 0 1 0 | E E A E | (1-k)(c-b) → $\frac{4(1-K)}{15}$.NTb |
| 1 0 1 0 | A E A E | (1-k)(c-b+a) → $\frac{5(1-K)}{15}$.NTb |
| 0 1 1 0 | E A A E | (1-k)(c-a) → $\frac{6(1-K)}{15}$.NTb |
| 1 1 1 0 | A A A E | (1-k)c → $\frac{7(1-K)}{15}$.NTb |
| 0 0 0 1 | E E E A | (1-k)(1-c) → $\frac{8(1-K)}{15}$.NTb |
| 1 0 0 1 | A E E A | (1-k)(1-c+a) → $\frac{9(1-K)}{15}$.NTb |
| 0 1 0 1 | E A E A | (1-k)(1-c+b-a) → $\frac{10(1-K)}{15}$.NTb |
| 1 1 0 1 | A A E A | (1-k)(1-c+b) → $\frac{11(1-K)}{15}$.NTb |
| 0 0 1 1 | E E A A | (1-k)(1-b) → $\frac{12(1-K)}{15}$.NTb |
| 1 0 1 1 | A E A A | (1-k)(1-b+a) → $\frac{13(1-K)}{15}$.NTb |
| 0 1 1 1 | E A A A | (1-k)(1-a) → $\frac{14(1-K)}{15}$.NTb |
| 1 1 1 1 | A A A A | (1-k) → $\frac{15(1-K)}{15}$.NTb |

| TONE LEVEL | ORDER AT THE INSTANT 0 | a | b | c | PERIOD OF ILLUMINATION OR LUMINANCE | |
|---|---|---|---|---|---|---|
| 0 0 0 0 | E | E | E | E | 0 | $\frac{0}{15}\cdot NTb$ |
| 1 0 0 0 | A | E | E | E | a-0 | $\frac{1}{15}\cdot NTb$ |
| 0 1 0 0 | E | A | E | E | b-a | $\frac{2}{15}\cdot NTb$ |
| 1 1 0 0 | A | A | E | E | b | $\frac{3}{15}\cdot NTb$ |
| 0 0 1 0 | E | E | A | E | c-b | $\frac{4}{15}\cdot NTb$ |
| 1 0 1 0 | A | E | A | E | c-b+a | $\frac{5}{15}\cdot NTb$ |
| 0 1 1 0 | E | A | A | E | c-a | $\frac{6}{15}\cdot NTb$ |
| 1 1 1 0 | A | A | A | E | c | $\frac{7}{15}\cdot NTb$ |
| 0 0 0 1 | E | E | E | A | 1-c | $\frac{8}{15}\cdot NTb$ |
| 1 0 0 1 | A | E | E | A | 1-c+a | $\frac{9}{15}\cdot NTb$ |
| 0 1 0 1 | E | A | E | A | 1-c+b-a | $\frac{10}{15}\cdot NTb$ |
| 1 1 0 1 | A | A | E | A | 1-c+b | $\frac{11}{15}\cdot NTb$ |
| 0 0 1 1 | E | E | A | A | 1-b | $\frac{12}{15}\cdot NTb$ |
| 1 0 1 1 | A | E | A | A | 1-b+a | $\frac{13}{15}\cdot NTb$ |
| 0 1 1 1 | E | A | A | A | 1-a | $\frac{14}{15}\cdot NTb$ |
| 1 1 1 1 | A | A | A | A | 1 | $\frac{15}{15}\cdot NTb$ |

FIG.2

*PRIOR ART*

| TONE LEVEL | ORDER AT THE INSTANT 0' a' b' c' | PERIOD OF ILLUMINATION OR LUMINANCE |
|---|---|---|
| 0 0 0 0 | E E E E | (1-k)0 → $\frac{0}{15}$.NTb |
| 1 0 0 0 | A E E E | (1-k)a → $\frac{(1-K)}{15}$.NTb |
| 0 1 0 0 | E A E E | (1-k)(b-a) → $\frac{2(1-K)}{15}$.NTb |
| 1 1 0 0 | A A E E | (1-k)b → $\frac{3(1-K)}{15}$.NTb |
| 0 0 1 0 | E E A E | (1-k)(c-b) → $\frac{4(1-K)}{15}$.NTb |
| 1 0 1 0 | A E A E | (1-k)(c-b+a) → $\frac{5(1-K)}{15}$.NTb |
| 0 1 1 0 | E A A E | (1-k)(c-a) → $\frac{6(1-K)}{15}$.NTb |
| 1 1 1 0 | A A A E | (1-k)c → $\frac{7(1-K)}{15}$.NTb |
| 0 0 0 1 | E E E A | (1-k)(1-c) → $\frac{8(1-K)}{15}$.NTb |
| 1 0 0 1 | A E E A | (1-k)(1-c+a) → $\frac{9(1-K)}{15}$.NTb |
| 0 1 0 1 | E A E A | (1-k)(1-c+b-a) → $\frac{10(1-K)}{15}$.NTb |
| 1 1 0 1 | A A E A | (1-k)(1-c+b) → $\frac{11(1-K)}{15}$.NTb |
| 0 0 1 1 | E E A A | (1-k)(1-b) → $\frac{12(1-K)}{15}$.NTb |
| 1 0 1 1 | A E A A | (1-k)(1-b+a) → $\frac{13(1-K)}{15}$.NTb |
| 0 1 1 1 | E A A A | (1-k)(1-a) → $\frac{14(1-K)}{15}$.NTb |
| 1 1 1 1 | A A A A | (1-k) → $\frac{15(1-K)}{15}$.NTb |

FIG. 6

METHOD FOR ADJUSTING THE OVERALL LUMINOSITY OF A BISTABLE MATRIX SCREEN DISPLAYING HALF-TONES

This application is a Continuation of application Ser. No. 08/348,122, filed Nov. 28, 1994, now abandoned.

BACKGROUND OF THE INVENTION

1. Field of the Invention

The present invention relates to a method for adjusting the overall luminosity of a bistable matrix screen displaying half-tones. It also relates to a display device that uses the method.

The invention can be applied to screens of the type having an internal memory. A screen with an internal memory is a screen whose cells, which form the pixels, preserve the "written" state or the "extinguished" state after the end of the signal activating the "written" state or the "extinguished" state as is the case notably with plasma panels and especially with alternating type plasma panels.

The screens to which the invention applies comprise elementary cells arranged in rows and columns in matrix form.

The use of display screens in a very wide variety of luminous environments may lead to the adjusting of their overall luminance as a function of the ambient luminosity in which they are used. In fact, it is recommended that the overall luminance of the screen should be comparable to that of the environment, otherwise unnecessary fatigue will be created for the user. The conditions of illumination around the screen may vary by a factor of about 1000 (from some tens of lux indoors with attenuated illumination to some tens of thousands of lux outdoors in sunlight).

The description shall be made in the case of a alternating type of plasma display panel. However, the invention can be applied to other types of bistable display panels, for example liquid-crystal display screens.

2. Description of the Prior Art

The working and structure of alternating-type plasma panels is well known. These panels, are for example, of the crossed-electrode type defining a cell as described in the French patent FR-2 417 848. The addressing of a given cell is achieved by the selection of two crossed electrodes to which appropriate voltages are applied at a given instant so that the difference in potential prompts a writing discharge or an erasure discharge between these electrodes.

A standard method of addressing consists of a row-by-row operation. In this case, all the cells of a given row simultaneously receive a command, by means of a semi-selective operation, for them to be erased or written on, for example to be erased, and this operation is followed by a selective operation during which at least one of the cells of the row is written on.

The semi-selective operation followed by the selective operation is accomplished, for each row, with a time lag from one row to the other corresponding to the duration of a row cycle.

Generally, the addressing by semi-selective operation and selective operation is done by a method in which addressing square-wave signals are overlaid on basic square-wave signals as explained, for example, in the patents FR-2 635 901 and FR-2 635 902.

These basic square-wave signals are applied simultaneously to all the cells for a period constituting an addressing stage and the addressing square-wave signals are overlaid on these basic square-wave signals only for the rows of cells addressed with, from one row to the other, the time lag corresponding to the duration of a row cycle T1; this means that the starting points of two consecutive addressing stages are separated by the duration of the row cycle.

Generally, in each row cycle, the addressing stage is followed by a sustaining stage during which the cells in the written state are activated, i.e. they produce light. Indeed, in this sustaining stage, sustaining signals are applied simultaneously to all the cells and prompt sustaining discharges that provide the essential part of the light emission perceived by an observer.

The sustaining signal is an alternating signal formed by voltage square waves that succeed one another with opposite polarities: each change in sign of the alternating signal (leading edges or trailing edges) generates a discharge in the gas or an emission of light in the cell or cells concerned. Thus, the quantity of light emitted by a cell in the illuminated state, namely the written state, is substantially proportional to the number of edges corresponding to polarity changes and, consequently, to the frequency of the sustaining signal.

It must be noted that in the addressing stage, as regards both recording and erasure, the basic square-wave signals have substantially one and the same amplitude as the sustaining signals and, consequently, they too may generate discharges comparable to the sustaining discharges, with light emission. Consequently, it may be assumed that the addressing stages contain at least one sustaining cycle.

To adjust the overall luminosity of an alternating type plasma panel, there is a known way of causing variation in the frequency of the sustaining signals. By making this frequency adjustable, the overall luminance of the panel is adjusted.

There is also a known way, described in the patent FR-2 662 292, of separating the selective (recording) operation from the semi-selective operation by an adjustable period that is substantially equal to a fraction of an image frame period, this fraction representing a percentage of the maximum luminosity. It may be recalled that the image frame period corresponds to the time needed to display an image.

It is increasingly being sought to display images in half-tones. In this type of display panel, each cell has several levels of illumination. The French patent FR-2 536 565 has proposed the processing, of all the rows of the panel several times and non-periodically in order to have several illumination periods for each cell.

This method uses several scans that are interleaved.

This method cannot be used to adopt the method for adjusting the overall luminosity which consists in separating the selective recording operation from the semi-selective operation since it is already necessary to distribute several commands for the recording and erasure of a row during a frame period.

Furthermore, it is difficult to adapt the method for adjusting the overall luminosity by variation of the sustaining frequency to the systems of half-tone displays using the above method since the processing rates of each row are imposed.

Up to now, no half-tone display method has been proposed enabling an adjustment of the overall luminosity.

SUMMARY OF THE INVENTION

The present invention proposes a method for adjusting the overall luminosity of at least a part of a half-tone display screen.

The method according to the invention consists in processing each row of the part of screen several times, non-periodically, in a semi-selective operation followed by a selective operation, a delay being planned between the selective operation and the semi-selective operation, said delay being proportional to a weighting factor k(o<k<1) adjustable as a function of the desired overall luminosity and proportional to the time interval between the start of the processing operation in progress and the start of the next processing operation.

This method is simple to implement and makes it possible to obtain a dynamic range of adjustment for a constant number of half-tones wherein the greater the number of rows, the greater is this dynamic range of adjustment.

The present invention also relates to a display device to which the method for the adjusting of overall luminosity can be applied.

BRIEF DESCRIPTION OF THE DRAWINGS

The invention will be understood more clearly from the following description, made by way of a non-restrictive example, with reference to the appended figures, of which:

FIG. 2 gives a representation, in a table, of the state of a cell at different instants and the period of illumination of the cell as a function of its tone level, with the known method;

FIG. 6 gives a view, in a table, of the state of a cell at different instants and the period of illumination of the cell as a function of its tone level with the method according to the invention;

MORE DETAILED DESCRIPTION

Figure 1:
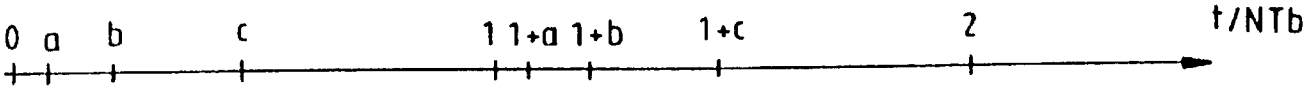
FIG.1 PRIOR ART
FIG. 1 is a graph giving the instants of processing of a row of a screen displaying half-tones with a known method.

FIG. 1 is a graph giving a view, in time, of the instants of processing of a row 1 of a bistable screen by the known method of half-tone generation without adjustment of luminosity. Each row is processed N times to display an image. In the non-restrictive example shown, N=4.

Tb represents the time taken to process all the rows of the screen once.

The time needed to display an image or the frame time is therefore T=N.Tb.

The row 1 is processed at the successive instants 0, a, b, c, 1, 1+a, 1+b, 1+c, 2 . . . with 0<a<1, 0<b<1, 0<c<1 and a<b<c The processing operations applied at the instants 0, a, b, c, are designed to keep or modify the written or extinguished state of the cells of the row 1.

N scans per image make it possible to obtain $2^N$ different tone levels (generally grey levels) for each cell if the instants a, b, c, etc. are judiciously chosen. It is possible, for example, to choose them so as to obtain a geometric progression. We then have:

$$a-0=2^0/2^N-1$$

$$b-a=2^1/2^N-1$$

$$c-b=2^2/2^N-1$$

$$1-c=2^3/2^N-1$$

In other words, the time intervals between two successive processing operations for the same row increase proportionally by the power of two. In the graph of FIG. 1, the following values have been chosen:

$$a=1/2^N-1=1/15$$

$$b=3/2^N-1=3/15$$

$$c=7/2^N-1=7/15$$

$$1=15/2^N-1=15/15$$

The table of FIG. 2 gives a view, for a cell controlled by the known half-tone display method, of the possible tone levels, the state of the cell at the instants 0, a, b, c and its period of illumination or luminance. The first column shows the tone level encoded in binary mode. The first bit is the least significant bit and the last bit is the most significant bit. The next column shows the commands to be applied to the cell at the instants 0, a, b, c. At the instant 0, the first bit is used. At the instant a, the second bit is used, at the instant b the third bit is used and at the instant c the last bit is used. If the bit equals 0, the cell is erased E and if the bit equals 1, the cell is illuminated A. The last column gives the period of illumination of the cell as a function of the frame time T=NTb for each tone level. The illumination times may thus take 16 different values ranging from 0 to NTb.

Let us take the example of a conventional plasma panel screen comprising 480 rows of cells processed 50 times per second with a frame time of 20 ms. If it is desired to display an image with four half-tones on this screen, all the rows of the screen need to be processed twice in 20 ms.

The row cycle is equal to: Tl=20/(480.2)=20.8 $\mu$s.

This period Tl is just enough to carry out an addressing phase. No sustaining phase is added. This period corresponds to the time taken to carry out a semi-selective operation followed by a selective operation.

Figure 3:
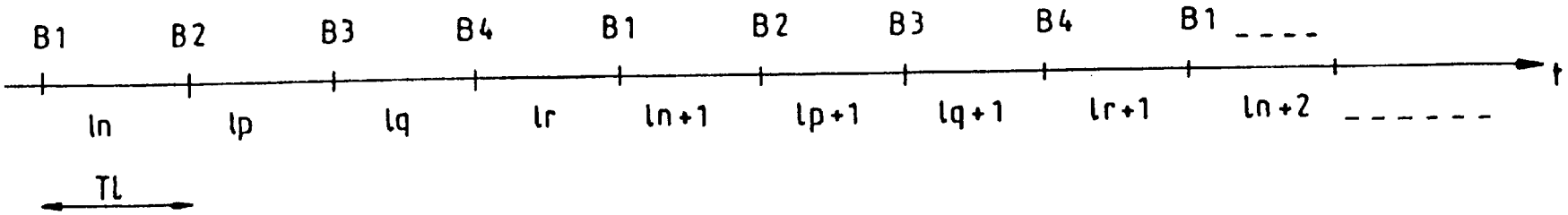
FIG.3 PRIOR ART
FIG. 3 gives a view, in time, of the succession of scans by which the rows of the screen are processed with the known method.

In this method, the scans are interleaved. FIG. 3 shows the succession of scans and the rows processed with the method. Four interleaved scans are performed. They are referenced B1, B2, B3, B4. The time taken to process a row is Tl.

The period Tl of the first scan B1 which processes an n-order row in of the screen is followed by another period Tl of the second scan B2 which processes a p (p≠n) order row lp, then another period Tl of the scan B3 which processes a q-order row lq and then again, during another period Tl, the scan B4 which processes an r-order row lr. The operation is then resumed with the scan B1 which processes the row ln+1, then the scan B2 which processes the row lp+1, etc. The image is displayed when all the rows have been processed once by each scan. Thus, each scan processes the panel row by row in an ordered way. Each row 1 will have been scanned four times by the scans B1, B2, B3, B4 at successive instants corresponding to the graph of FIG. 1.

Figure 4:
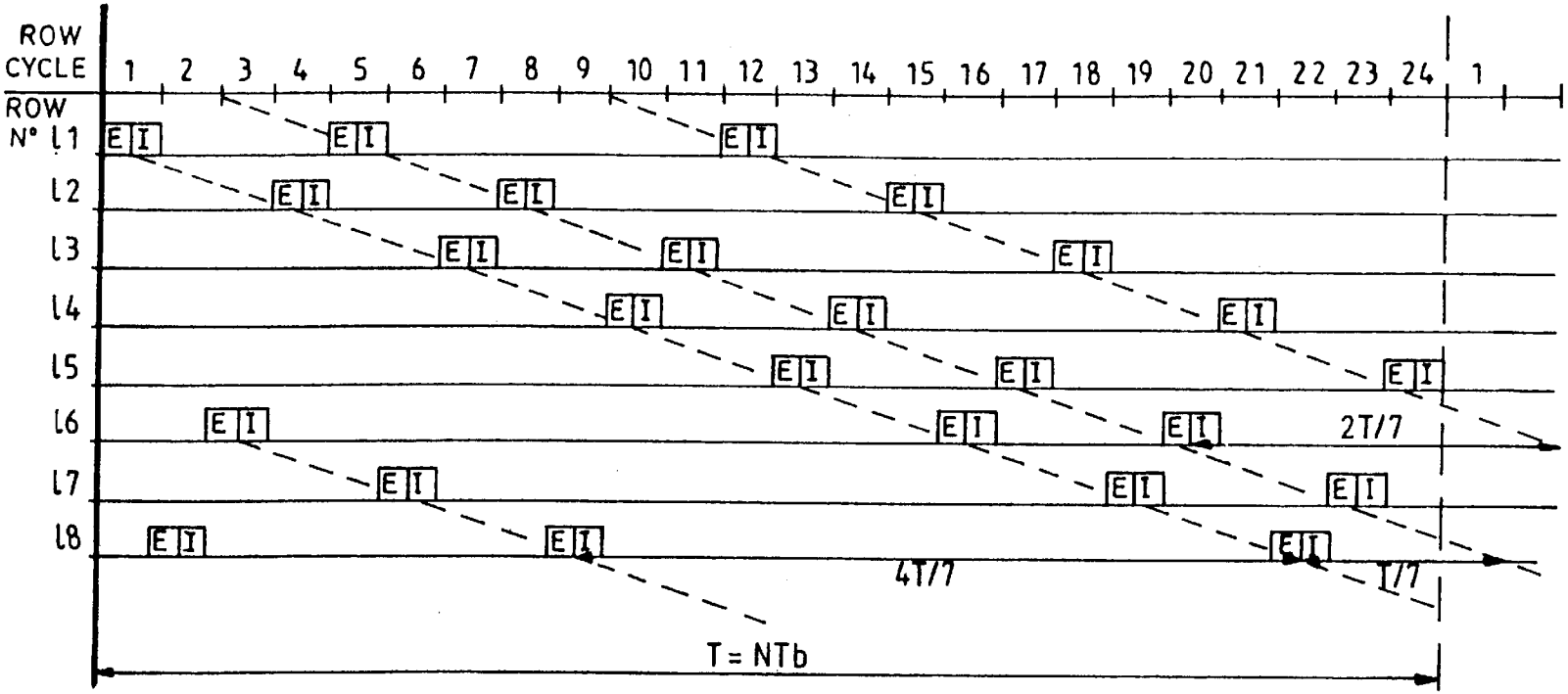
FIG.4 PRIOR ART
FIG. 4 gives a view, in time, for an eight-row and eight half-tone panel, of the processing operations applied with the known method.

FIG. 4 shows an exemplary view of the operations for scanning a screen of a plasma panel having eight rows, on which it is desired to display eight half-tones by the known method. The choice of the same number of rows and half-tones is but a coincidence. Three interleaved scans are made. The time axis is divided into 24 periods corresponding to 24 row cycles Tl numbered 1 to 24. Each processing of a row comprises a semi-selective operation E (erasure for example) followed by a selective operation 1 (recording for example). The two operations take place for one and the same row during the same row cycle Tl.

This figure does not show the basic square-wave signals which are applied simultaneously to all the cells but only the addressing square-wave signals which correspond to the semi-selective and selective operations. It can be ascertained that, for one and the same row, the time intervals between two successive processing operations increase in geometric progression. For the first row for example, the interval between the first two processing operations corresponds to one-seventh of the frame time T. The next interval is 2T/7 and the interval that follows is 4T/7.

Figure 5:
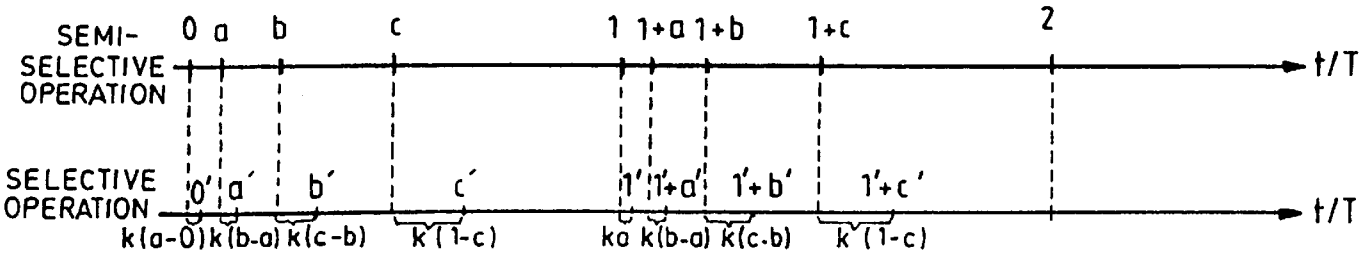
FIG. 5 shows a graph giving the instants of the processing of a row of a screen displaying half-tones with a method according to the invention.

FIG. 5 shows the distribution in time of the operations for processing a row with the method according to the method, this method enabling the adjusting of the overall luminosity in the case of a half-tone display. According to the invention, for a row each processing operation comprises a semi-selective operation followed by a selective operation. For at least one given processing operation, the selective operation is separated from the semi-selective operation by a time interval that is weighted with respect to the time interval between the beginning of this processing operation and the beginning of the next processing operation.

It has been assumed in FIG. 5 that for the row considered the semi-selective operations always take place at the instants 0, a, b, c, 1, 1+a, 1+b, 1+c, etc.

The selective operations then take place respectively at the instants:

$$0'=k(a-0)$$

$$a'=k(b-a)$$

$$b'=k(c-b)$$

$$c'=k(1-c)$$

Where k is a constant ranging from 0 to 1, used as a weighting parameter to adjust the overall luminosity of the screen of the panel. The value of k, in this example, determines the time intervals during which the cells are forced into the extinguished state.

The delay between the selective operation and the semi-selective operation is proportional to this parameter k and to the time interval between the beginning of the semi-selective operation of the processing operation in progress and the beginning of the semi-selective operation of the next processing operation. The different values of the delay therefore increase in a geometrical progression as the intervals between the beginning of the different processing operations.

FIG. 6 assembles, in one table and for each tone level (16 possibilities), the state of a cell at the instants 0', a', b', c' and the period of illumination or luminance of the cell, this cell being controlled by the method according to the invention. It can be verified that the progression of the periods of illumination is kept. The overall luminosity of the screen of the panel is modified in a ratio of 1−k.

Figure 7:
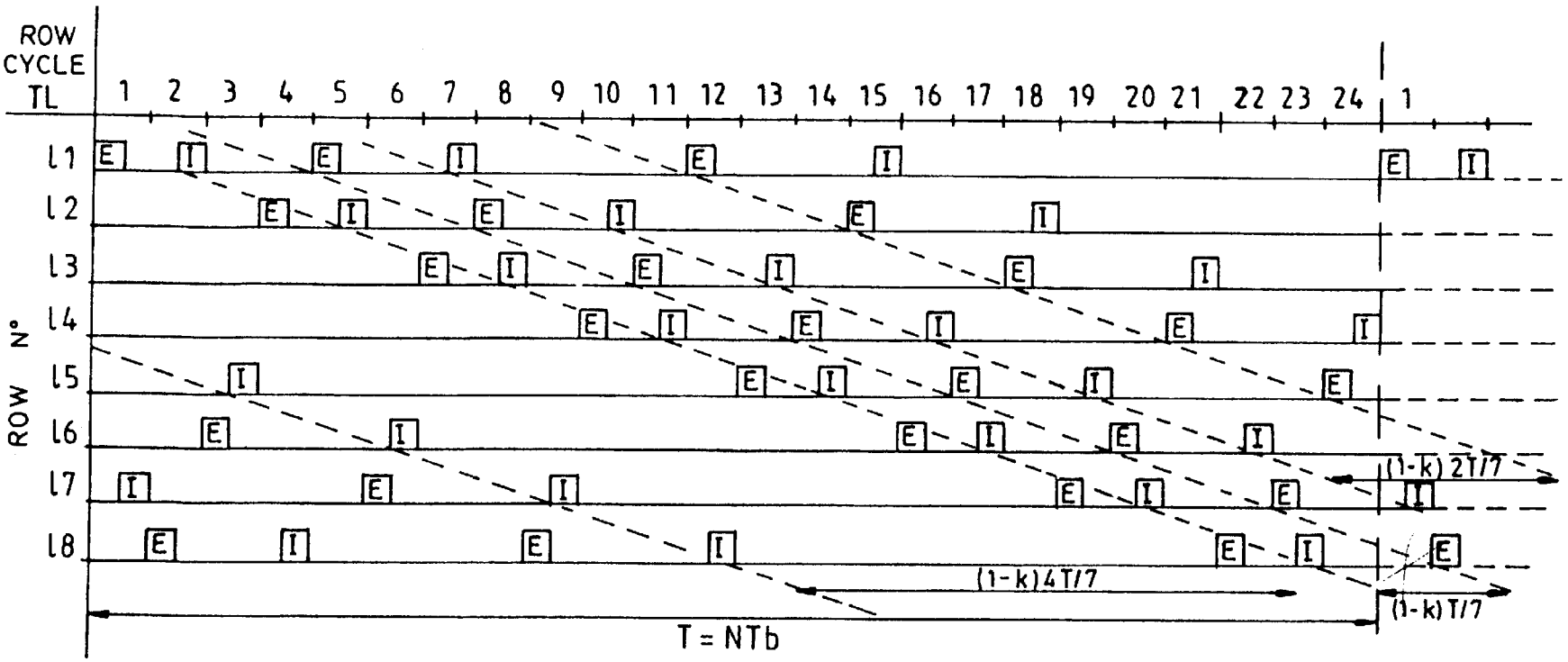
FIG. 7 gives a view in time, for an eight-row and eight half-tone panel, of the processing operations applied to these rows with the method according to the invention.

FIG. 7 resumes the example of an eight-row screen displaying eight half-tones to which there is applied a method for the adjusting of the overall luminosity according to the invention. Interleaved scans are used to address the cells of the screen.

However, in this case to obtain $2^N$ half-tones, there are N scans needed, each scan being formed by two sub-scans. N sub-scans B1, B2, B3, . . . , BN of a first group carry out semi-selective operations and N sub-scans B'1, B'2, B'3, . . . , B'N of a second group carry out selective operations. There is a decorrelation between the sub-scans that generate the erasure and the sub-scans that generate the recording. It is assumed that a row cycle corresponds to the time taken to carry out a semi-selective operation followed by a selective operation.

Figure 9:
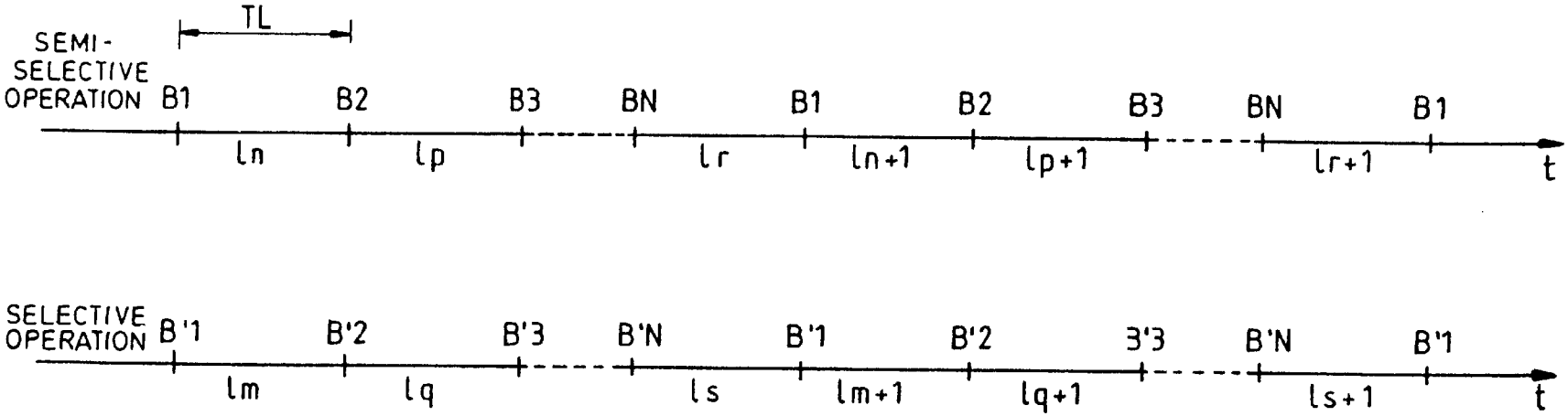
FIG. 9 gives a view, in time, of the succession of sub-scans by which the rows of the screen are processed with the method according to the invention.

FIG. 9 shows a view, in time, of the succession of sub-scans that process the rows of the screen with the method according to the invention.

During the first half of the first row cycle Tl, the first sub-scan B1 of the first group achieves a semi-selective operation on the n-order row ln. During the second half, the first sub-scan B'1 of the second group achieves out a selective operation on the m (m≠n) order row lm.

During the first half of the second row cycle Tl, the second sub-scan B2 of the first group achieves a semi-selective operation on the p (p≠n) order row lp and during the second half of the second row cycle Tl, the second sub-scan B'2 of the second group achieves a selective operation on the q (q≠m) order row lq. The succession of the sub-scans is carried out in this way until the last sub-scan B'N of the second group which carries out a selective operation on the s-order row ls. Then, during the first half of the following row cycle, the first sub-scan B1 of the first group achieves a semi-selective operation on the n+1 order row ln+1. The image is displayed when each sub-scan has processed all the rows at least once.

In the example shown in FIG. 7, during the first half of the first row cycle Tl, the row 11 is erased by the sub-scan B1 and during the second half of the first row cycle Tl the row 17 is written on by the sub-scan B'1. During the next cycle Tl, the row 18 is erased by the sub-scan B2 and then the row 11 undergoes recording by the sub-scan B'2. During the third row cycle Tl, the row 16 is erased by the sub-scan B3 and then the row 15 undergoes recording by the sub-scan B'3. During the next cycle Tl, the sub-scan B1 erases the row 12 and then the sub-scan B'1 achieves a recording on the row 18. During each row cycle, a row is addressed semi-selectively and then another row is addressed selectively. Each sub-scan achieves an ordered processing, either in erasure or in recording mode, of all the rows of the screen.

In FIG. 7, the weighting parameter k is chosen to be equal to 0.3. This gives an overall luminance of 70% of the maximum luminance.

The dynamic range of the adjustment is limited by the smallest possible variation in luminosity Δl.

$$\Delta l = \frac{2N-1}{NL}$$

N is the number of scans and NL is the number of rows.

The dynamic range of adjustment is equal to the ratio of the maximum luminance to the minimum luminance. The minimum luminance is approximately equal to the product of the maximum luminance and of deltal.

In a panel with NL=480 and N=2, giving four half-tones:

$$\Delta l = \frac{3}{480} \cong 0.6\%$$

The dynamic range of adjustment is equal to 160. In other words, the method according to the invention makes it possible to obtain 160 different levels of luminance.

In a screen with NL=512 and N=8 giving 256 half-tones:

$$\Delta l = \frac{255}{512} = 50\%$$

The dynamic range of adjustment is equal to about 2.

In the above description, it has been assumed that the method according to the invention is applicable to all the rows of the screen. It is of course possible to apply it only to a part of the screen, for example to a half-screen. Only the rows of this part will be processed by the method that has been described.

Figure 8:
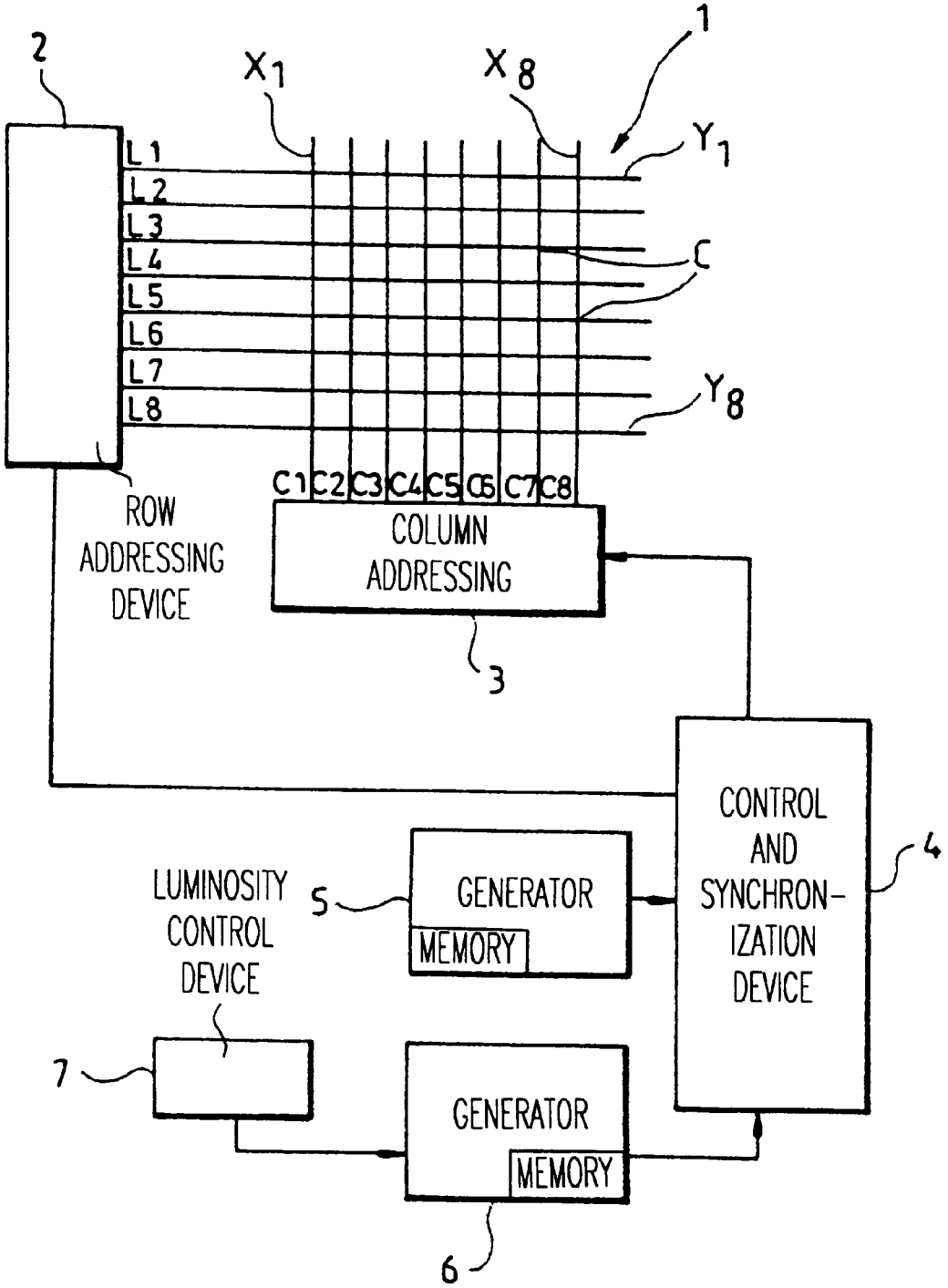
FIG. 8 gives a schematic view of a display device using the method according to the invention.

FIG. 8 gives a schematic view, by way of a non-restrictive example, of an alternating plasma panel 1 to which the method according to the invention can be applied. This panel 1 has column electrodes X1 to X8 orthogonal to the row electrodes Y1 to Y8. Each intersection between a column electrode and a row electrode defines a cell C which represents a pixel. The panel 1 has eight rows (L1 to L8) and eight columns (C1 to C8) giving 64 cells C. There could be many more or far fewer cells C. The row electrodes Y1 to Y8 are connected to an addressing device 2. This device superimposes addressing square-wave signals on a sustaining signal made in the form of basic square-waves that are always present on all the rows, for the semi-selective erasure command or for the selective recording command applied to the addressed row or rows.

The column electrodes X1 to X8 are also connected to an addressing device 3 which makes a selective application, during the recording command, of masking pulses solely to the columns which correspond to the cells C that do not have to be subjected to writing.

The synchronization between the signals applied to the row electrodes Y1 to Y8 and to the column electrodes X1 to X8 is symbolized in the figure by a control and synchronization device 4 which is connected to the two addressing devices 2 and 3.

The control and synchronization device 4 receives firstly the number of the row to be erased from a generator 5 of the sequencing of the semi-selective operations (erasure) and secondly the number of the row to be written on from a generator 6 of the sequencing of the selective operations (recordings).

These two sequencing generators may be formed by read-only memories as shown in FIG. 8. At least one sequencing is memorized in the sequencing generators. For example, a single sequencing may be memorized in the generator 5 for the sequencing of the erasures and several different sequencing operations may be memorized in the generator 6 of the sequencing of the recordings, each sequencing corresponding to a different level of overall luminosity. It is enough to choose the desired level of luminosity by means of a luminosity control device 7 placed at the disposal of the user. This control device may be a selector switch or any other equivalent system. It is connected to the generator of the sequencing of the recordings 6. This control device makes a selection, in the read-only memory of the generator 6, of the zone in which the sequencing of the rows to be written on is stored in order to obtain the desired level of luminosity. It is of course possible, conversely, to provide for only one sequencing memorized in the generator 6 of the sequencing of the recordings and several sequencings memorized in the generator 5 of the sequencing of the erasures. The luminosity control device 7 would then be connected to the generator of the sequencing of the erasures.

In all the examples described, it has been assumed that the semi-selective operation corresponds to an erasure and that the selective operation corresponds to a recording. It has thus been possible to adjust the luminosity of the written information on the display panel by adjusting the weighting parameter k. It would of course be possible for the semi-selective operation to correspond to a recording and the selective operation to an erasure. Thus, the luminosity of the background of the display panel screen would be adjusted by adjusting the weighting parameter k.

The examples described relate to alternating type plasma panels. The method according to the invention can also be applied notably to liquid crystal panels or certain electroluminescent panels. Liquid crystal panels do not themselves produce light but work in transmission and modulate the light of a source before which they are placed. By applying the method according to the invention to these panels, the transmission time of the light is adjusted in order to adjust the overall luminosity.

What is claimed is:

1. A method for adjusting an overall luminosity of at least a part of a screen comprising cells arranged in rows and columns and configured to display half tones, comprising the steps of:

applying to a first row a semi-selective operation followed by a selective operation, said selective operation being delayed from said semi-selective operation by a weighted delay time having a duration equal to a time interval between said application of said semi-selective operation and a next subsequent semi-selective operation multiplied by a factor k, said factor being chosen between 0 and 1 and being adjustable to the desired luminosity, and repeating said applying step non-periodically to said first row, in order to display an image with half tones, the duration of a first weighted delay time between a first selective operation and a first semi-selective operation being different from the duration of a second weighted delay time between a second selective operation and a second semi-selective operation for a same value of said factor.

2. The method of claim 1, further comprising the step of:

interleaving said applying step and said repeating step for said first row with corresponding applying steps and repeating steps for at least a second row of said rows.

3. The method of claim 2, wherein said applying step comprises:

applying said semi-selective operation which is from a first group of sub-scans; and applying said selective operation which is from a second group of sub-scans, wherein said first group of sub-scans and said second group of sub-scans are applied to all of said rows of said at least part of a screen in an ordered way.

4. The method of claim 3, wherein said interleaving step comprises:

applying to a n order row a first sub-scan taken from the first group, applying to a m order row a second sub-scan taken from the second group, where m is different than n, applying to a p order row a third sub-scan taken from the first group, where p is different than n;

applying to a q order row a fourth sub-scan taken from the second group, where q is different than m;

applying to additional rows in a similar pattern each of the other remaining sub-scans from the first group and the second group until all of the sub-scans have been taken; and repeating said steps of applying to a n, m, p, q, and additional order rows for corresponding n+1, m+1, p+1, q+1 and further additional rows in a similar manner until each of the sub-scans has been applied to corresponding rows of said part of the screen at least once.

5. The method of claim 1, wherein said applying step comprises:

applying said selective operation to record a bit value on one of the cells; and applying said semi-selective operation to erase one of the cells.

6. The method of claim 1, wherein said applying step comprises:

applying said semi-selective operation to record a bit value on one of the cells; and applying said selective operation to erase one of the cells.

7. The method of claim 1, wherein said applying step comprises applying said semi-selective operation and said selective operation to a first row of a plasma panel.

8. The method of claim 1, wherein said applying step comprises applying the semi-selective operation and the selective operation to a first row of a liquid crystal display.

9. An adjustable half-tone display system comprising:

a bistable matrix screen having rows and columns;

a first addressing device connected to said rows;

a second addressing device connected to said columns;

a control and synchronization device connected between the first addressing device and the second addressing device;

a first generator which sequentially generates a selective operation; and a second generator which sequentially generates a semi-selective operation and a next subsequent semi-selective operation, wherein said first and second addressing devices, said control and synchronization device, and said first and second generators are configured to apply to a first row of said matrix screen the semi-selective operation followed by said selective operation, delayed the operation by a weighted delay time having a duration equal to the time interval between application of the semi-selective operation and the next subsequent semi-selective operation, multiplied by a factor k, chosen between 0 and 1 and adjustable to a desired luminosity, and configured to repeatedly apply other semi-selective operations and selective operations non-periodically to said row in order to display an image with half-tones, wherein the duration of a first weighted delay time between a first selective operation and a first semi-selective operation being different from the duration of a second weighted delay time between a second selective operation and a second semi-selective operation for a same value of said factor.

10. The adjustable half-tone display system of claim 9 wherein:

said first generator comprises a read-only memory; and said second generator comprises a read-only memory.

11. The adjustable half-tone display system of claim 9 wherein:

said first generator comprises a memory element which stores a first sequence; and said second generator comprises a memory element which stores a second sequence.

12. The adjustable half-tone display system of claim 9 further comprising:

an overall user-actuated luminosity control device connected to at least one of said first generator and said second generator.

13. The adjustable half-tone display system of claim 12, wherein said overall luminosity control device comprises a selector switch.

* * * * *